United States Patent [19]

Dusman et al.

[11] Patent Number: 4,531,395

[45] Date of Patent: Jul. 30, 1985

[54] MODULAR DRAWBEAD STRUCTURE

[75] Inventors: Richard J. Dusman, Warren; Harmon D. Nine, Fraser, both of Mich.

[73] Assignee: General Motors Corporation, Detroit, Mich.

[21] Appl. No.: 650,428

[22] Filed: Sep. 14, 1984

Related U.S. Application Data

[63] Continuation of Ser. No. 523,973, Aug. 17, 1983, abandoned.

[51] Int. Cl.[3] ..... B21D 22/00

[52] U.S. Cl. ..... 72/350; 72/341; 72/466

[58] Field of Search ..... 72/347, 348, 349, 350, 72/351, 466

[56] References Cited

U.S. PATENT DOCUMENTS

| | | | |
|---|---|---|---|
| 2,143,442 | 1/1939 | Kellogs | 72/466 X |
| 2,285,903 | 6/1942 | Clark | 72/350 |
| 3,664,172 | 5/1972 | Cvocho | 72/350 |

*Primary Examiner*—Leon Gilden
*Attorney, Agent, or Firm*—Herbert Furman

[57] ABSTRACT

Modular male and female drawbead structures comprise wafers of varying thickness which abut each other and are longitudinally wholly or partially aligned relative to each other in respective slots of die binders. The male structure has a body portion including a base wall and side walls which match and are spaced from like walls of a respective slot. A bead portion projects from an outer wall of the body portion and is joined thereby across concave shoulders. The female structure has a body portion including a base wall seating on the matching base wall of a respective slot and side walls which match and are spaced from like walls of a respective slot. A groove portion in the outer wall of the female module interfits with the bead portion and is joined to such outer wall by convex shoulders which match the concave shoulders. The male and female modules are releasably retained in their respective slots by side wall shims of semi-resilient material compressed between the side walls of the modules and the matching side walls of the respective slots. The male module is adjustable inwardly and outwardly of a respective slot by the use of a base wall shim of the same material as the side wall shims. The thickness of such shim controls the adjustment of the male module. In another embodiment, a number of wafers are formed integrally with each other into a module of a pre-determined length. In a third embodiment, a number of wafers are interconnected by flexible strips of semi-resilient material. In a fourth embodiment, folded or pleated metal straps provide the male and female modules. The bead and groove portions of the concave and convex shoulders are formed either on the junctures of such straps or on free edges thereof.

11 Claims, 17 Drawing Figures

MODULAR DRAWBEAD STRUCTURE

This is a continuation of application Ser. No. 523,973 filed on Aug. 17, 1983 now abandoned.

This invention relates generally to drawbead structures and more particularly to a modular drawbead structure which permits adjustment of the drawbead restraining force and permits a maximum restraining force to be obtained with relatively low penetration of the blank.

BACKGROUND OF THE INVENTION

Drawbead structures are used to control the flow of the sheet metal blank into a drawing die. Generally, known drawbead structures include a male drawbead structure or semi-cylindrical bead on the face of one die binder and a groove or female drawbead structure in the face of the opposing or other die binder. The drawbead structure is located outside the trim line of the drawn part since the edge portion of the sheet metal blank which passes through the drawbead structure is deformed and must be trimmed off.

The restraining force of such known drawbead structures results from a combination of deformation forces and friction forces. The deformation forces occur from the bending and straightening of the edge portion of the sheet metal blank as it passes around the radiused portion of the bead and the radiused shoulders of the groove. The friction forces occur from the rubbing contact of the sheet metal with the aforenoted radiused bead portion and shoulders. Generally 75% of the restraining force is due to deformation forces and 25% is due to friction forces.

Drawbead structures are conventionally built on and into the die during die tryout and the restraining force is set by adding material to the bead or groove, such as by welding, or removing material therefrom such as by grinding, in a trial and error manner. This is time consuming and expensive and is done manually.

SUMMARY OF THE INVENTION

The modular drawbead structure of this invention permits a wide range of adjustment of the drawbead restraining force to be obtained and also permits a maximum restraining force to be obtained at a relatively low penetration of the male drawbead structure with respect to the female drawbead structure. Both drawbead structures are modular and fit within slots located in the binder faces of the die binders. In a first embodiment, the male structure is a series of metal wafers of various thicknesses which abut each other longitudinally of the slot and are wholly or partially aligned. Each wafer includes a bead portion which projects from the outer wall of the body portion and merges into such outer wall across concave shaped shoulders. In a second embodiment, a number of such wafers are formed integrally with each other into a module of predetermined length. In a third embodiment, a number of such wafers are interconnected centrally thereof or at the sides or at the bottom thereof by connectors or lengths of semi-resilient material, such as urethane rubber, to form modules. In a fourth embodiment, a length or strap of metal or other suitable material is reversely folded or accordion pleated. In one form, the wafers are connected at their upper or outer walls which are shaped to provide the bead portions and concave shaped shoulders. The alternate lower junctures provide the base wall and the side edges provide the side walls. In another form of this embodiment, one set of side edges provides the outer wall and is shaped to provide the bead portion and shoulders.

The wafer embodiment, third embodiment, and the first form of the pleated embodiment wherein the bead portion and shoulders are formed on the junctures of the upper folds have the advantage of being able to fit into curved binder slots. This advantage cannot be obtained from any known drawbead structure.

The base and side walls of the body portion of the male structure are spaced from respective walls of the receiving slot in the die binder, as will be further explained.

The female structure may be any of the aforenoted embodiments or forms thereof. Each such embodiment includes a groove portion projecting within the body portion from the outer wall and merging into such outer wall across convex shoulders. The bead and groove portions and the concave and convex shoulders are of interfitting configuration and are formed on respective radii which differ by the thickness of the blank. Generally, the male and female embodiments will be the same although this is not required in all instances. The side walls of the body portion of the female structure are spaced from respective walls of the receiving slot in the die binder but the base wall of the body portion seats on the base wall of the slot.

The male structure is mounted in its receiving slot by the use of side wall shims of semi-resilient material, such as urethane rubber, between the side walls of the male structure and of the slot. In one form of the third embodiment, the side wall shims can be provided by the urethane rubber connectors at the sides of the wafers. The base wall of the male structure is spaced from the base wall of the slot by a base wall shim of the same semi-resilient material which fits between the side wall shims. The female structure is likewise mounted in its receiving slot by side wall shims of the same semi-resilient material. The base wall thereof seats on the base wall of the slot, although, if desired, space could be left between the base walls of the female structure and slot and a resilient base wall shim used.

By selecting a base wall shim of the desired thickness, the extent of projection of the male structure from its receiving slot may be set to thereby control the drawbead restraining force. The bead and groove portions and the concave and convex shoulders are of interfitting configuration, and higher drawbead restraining forces are obtained at lower penetration of the blank than are obtained from conventional drawbead structures. The side wall shims permit some movement of the male and female modules laterally of their respective slots so that the modules are self-centering. Additionally, the maximum restraining force which is obtained from the structure of this invention exceeds the maximum such force which can be obtained from conventional structures.

The primary feature of this invention is that it provides a modular drawbead structure which provides for adjustment of the drawbead restraining force. Another feature is that the drawbead structure permits a maximum restraining force to be obtained at relatively low penetration. A further feature is that the drawbead structure includes male and female modules which are releasably received within respective receiving slots in the faces of die binders. Yet another feature is that the male and female modules may comprise: (1) a longitudinal series of fully laterally movable wafers of the same or different thickness; (2) a series of such wafers which are connected by lengths of semi-resilient material; (3) an integral modular length of such wafers; or (4) a pleated or accordion folded length or strap. Yet a further feature is that the male module includes a body portion and a bead portion projecting from the outer wall of the body portion and merging into such outer wall across concave shoulders, while the female module includes a body portion and a groove portion projecting within the body portion from the outer wall thereof and merging into such outer wall across convex shoulders, with the bead and groove portions and the concave and convex shoulders interfitting to obtain high restraining forces with less blank penetration. Still another feature is that the body portion of the male module includes a base wall opposite the outer wall and side walls, with the base wall and side walls being spaced from respective walls of the receiving slot therefor, and with semi-resilient side wall shims being located between such spaced respective side walls to releasably mount the male module in its respective slot. Still a further feature is that the body portion of the female module likewise includes a base wall and side walls, with the base wall being seated on the matching base wall of the respective receiving slot and the side walls being spaced from the matching side walls of the receiving slot, with semi-resilient side wall shims being located between such spaced side walls to releasably mount the female module in its receiving slot and to permit slight self-centering relative movement of the male and female modules laterally of their respective slots. Yet another feature is that a base wall shim is inserted between the base walls of the male module and receiving slot to control the extent of projection of the male module from the binder face and thereby set the restraining force. Yet a further feature is that the base wall shim can be easily changed to one of different thickness to change the extent of projection of the male module and adjust the restraining force. Still another feature is that the receiving slot may be longitudinally arcuate to receive a male or female module comprised of wafers, free or connected, or of a pleated strap.

These and other features of the invention will be readily apparent from the following specification and drawings wherein.

Figure 7:
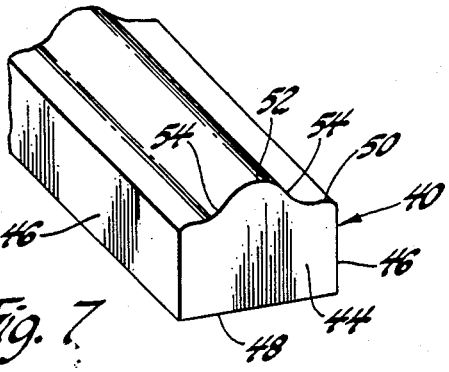
Figure 8:
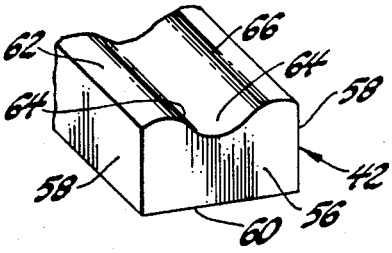
Figure 5:
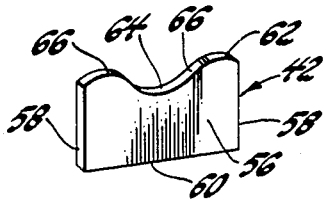
Figure 6:
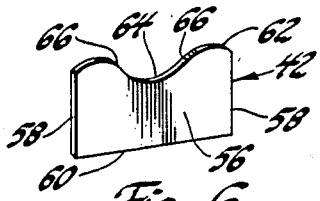
Figure 9:
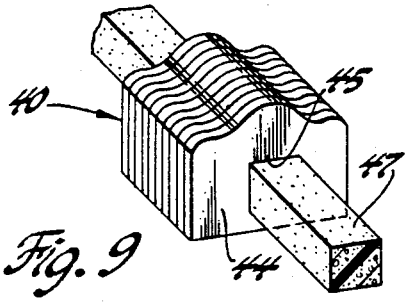
Figure 10:
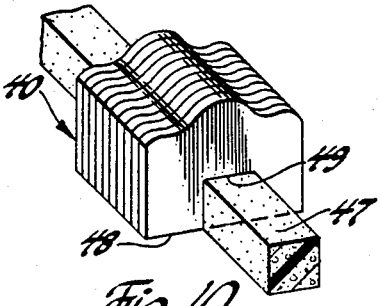
Figure 11:
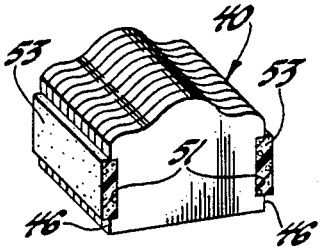
Figure 12:
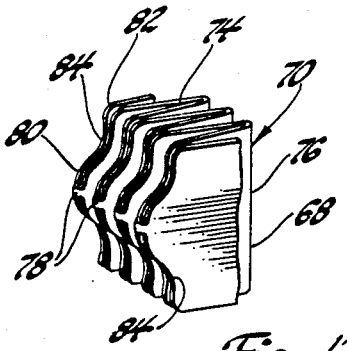
Figure 13:
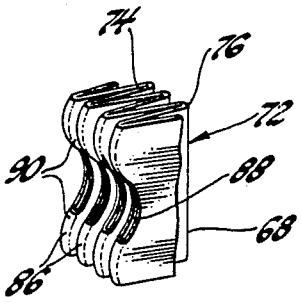
Figure 14:
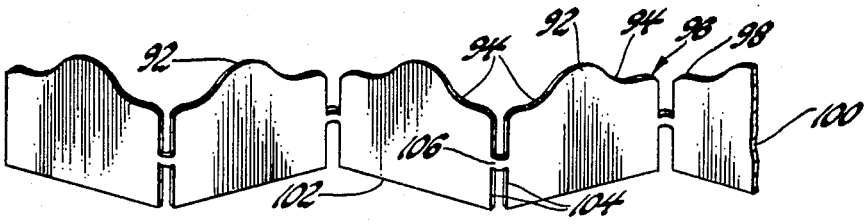
Figure 15:
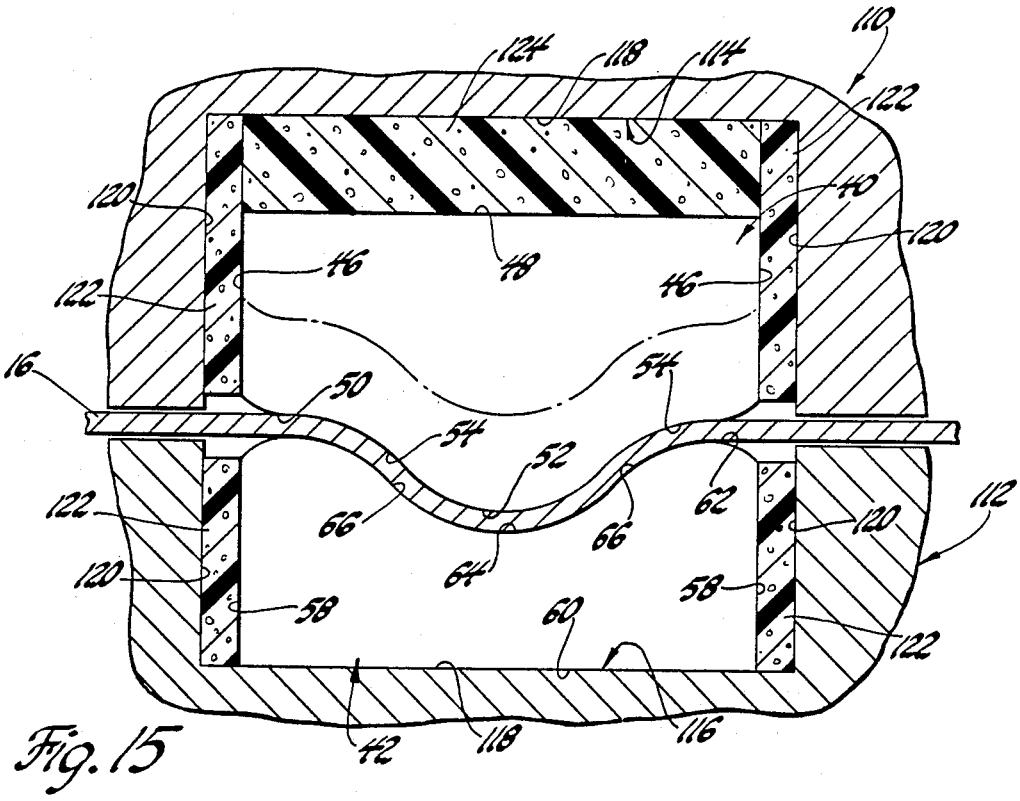
Figure 16:
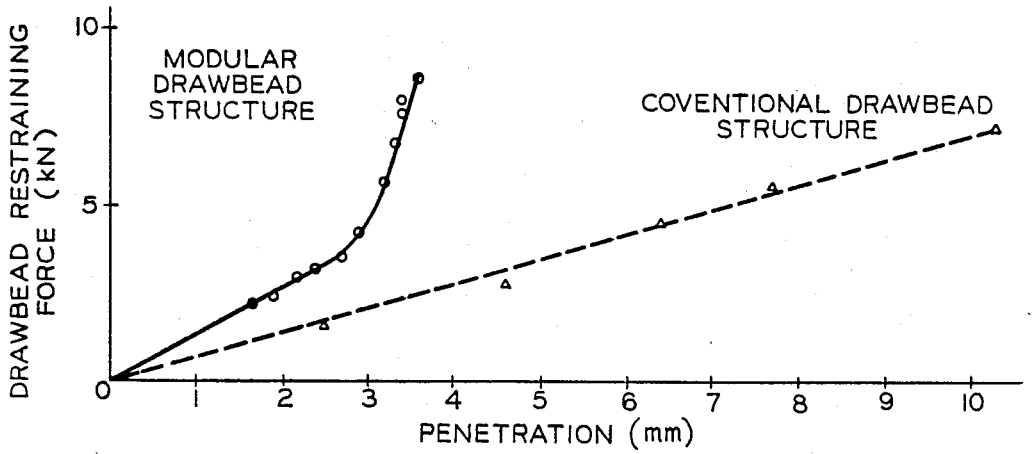

FIG. 5. is a view of a female structure of one form of the first embodiment;

FIG. 6 is a female structure of another form of the first embodiment;

FIG. 7 is a male structure of the second embodiment;

FIG. 8 is a female structure of the second embodiment;

FIG. 9 is a male structure of one form of the third embodiment;

FIG. 10 is a male structure of a second form of the third embodiment;

FIG. 11 is a male structure of a third form of the third embodiment;

FIG. 12 is a male structure of one form of a fourth embodiment;

FIG. 13 is a female structure of the one form of the fourth embodiment;

FIG. 14 is a male structure of a second form of the fourth embodiment;

FIG. 15 is a view showing male and female structures mounted in die binders;

FIG. 16 is a chart; and

Figure 17:
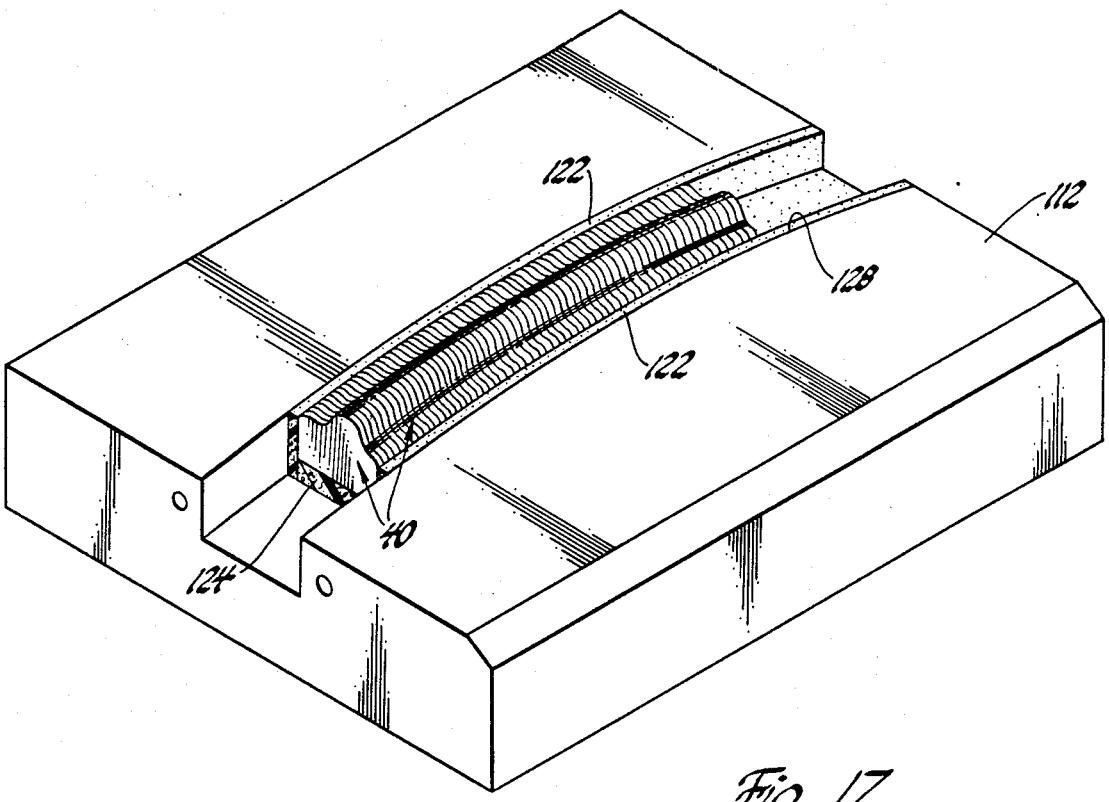

FIG. 17 is a view showing a male structure of the first embodiment mounted in a longitudinally arcuate slot of a binder.

Figure 1:
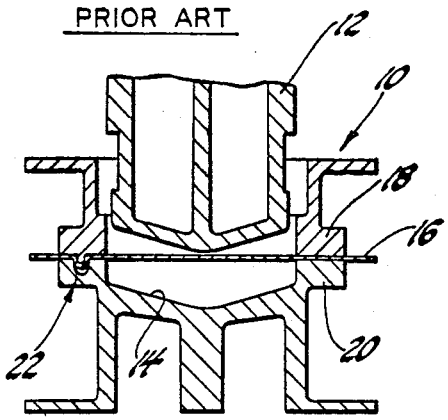
FIG. 1 is a schematic view of a press and conventional drawbead structure.
Figure 2:
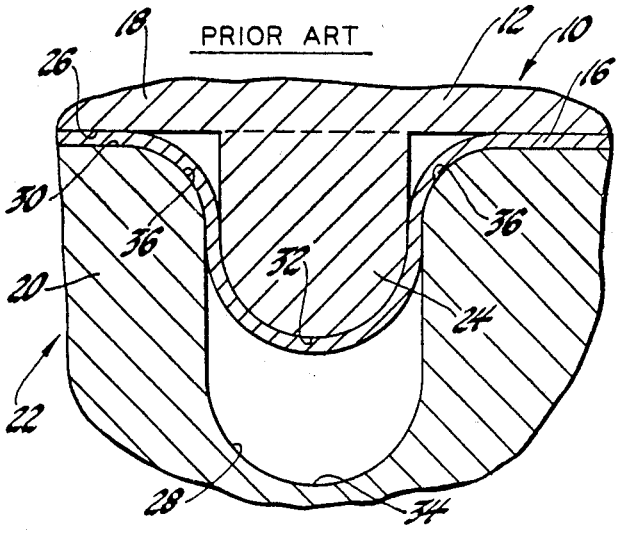
FIG. 2 is an enlarged view of a portion of FIG. 1.

Referring now to FIGS. 1 and 2 of the drawings, a conventional stamping press 10 is schematically indicated as including a punch 12 which moves inwardly and outwardly with respect to a die cavity 14 to form a stamped part from a blank 16 of sheet metal. The blank 16 extends across the die cavity. The edge portion of blank 16 is restricted against movement into the cavity when engaged by the punch 12 by upper and lower die binders 18 and 20 which releasably grip the edge portion of the blank 16 through a drawbead structure 22. The drawbead structure is shown enlarged in FIG. 2 and generally comprises a male structure or bead 24 which projects downwardly from the face 26 of the upper binder 18 and a female structure or groove 28 which projects inwardly from the face 30 of the lower binder 20. The bead includes a radiused portion 32 and the groove includes a radiused portion 34 and radiused convex shoulders 36 between the radiused portion 34 and the face 30. There are no radiused shoulders on the upper binder 18 opposite shoulders 36. The drawbead structure 22 may be continuous or discontinuous, as shown, around the cavity 14.

The extent of penetration of the bead 24 within the groove 28 controls the amount of restraining force applied to the blank 16 to resist movement of the blank within the cavity 14. In order to obtain maximum restraining force, the bead 24 must deeply penetrate into the groove 28. This severely deforms the edge portion of the blank 16 as it moves over the shoulders 36 and around the portion 32 so that the blank must be of a size to permit such deformation and to ensure that the deformed portion of the stamped part remains outside the trim line. Any changes made to the bead 24 or to the groove 28, such as adding material by welding, or removing material by grinding, must be made manually by a trial and error process and are expensive and time consuming.

Figure 3:
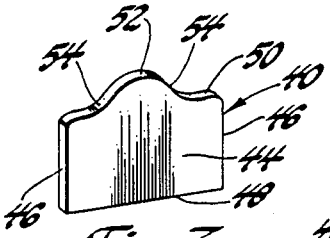
FIG. 3 is a view showing a male structure of one form of a first embodiment of the invention.
Figure 4:
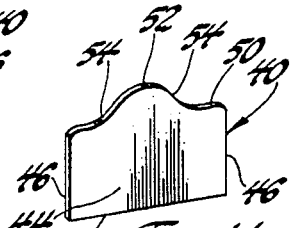
FIG. 4 is a view of a male structure of another form of the first embodiment of the invention.

Referring now to FIGS. 3 through 6 of the drawings, the first embodiment of the modular drawbead structure of this invention includes male and female drawbead modules 40, FIGS. 3 and 4, and female drawbead modules 42, FIGS. 5 and 6, in the form of wafers. The male wafers 40 may be of different thickness, compare FIGS. 3 and 4, to provide different forms of the first embodiment. Each form of module 40 includes a body portion 44 having side walls 46, a base wall 48 and an upper wall 50. A bead portion 52 projects from the upper wall 50 and merges into such wall across concave shaped shoulders 54. The female wafers 42, FIGS. 5 and 6, may also be of different thickness and include a body portion 56, side walls 58, a base wall 60 and an upper wall 62. A groove portion 64 projects inwardly within the body portion 56 from wall 62 and merges into the outer wall across convex shoulders 66. In the second embodiment of the invention, shown in FIGS. 7 and 8, the modules generally comprise a predetermined length of a number of integral wafers having the same cross-section as in the first embodiment. Therefore, like numerals have been used for like parts. In the first and second embodiments, the bead portion 52 and groove portion 64, and the shoulders 54 and 66 are of interfitting configuration and are formed on respective radii which differ by the thickness of the blank.

FIGS. 9, 10 and 11 show a third embodiment of the invention. In the form shown in FIG. 9, the male wafers 40 are the same as those of FIG. 3 and therefore like numerals have been used. In this form of the invention, the body portion 44 of each of a series of wafers 40 is provided with a generally rectangularly shaped opening 45. The openings 45 are generally aligned and receive a strip 47 of semi-resilient material, such as urethane rubber, to assemble the wafers 40 into a module of predetermined length. The length can vary and is set by the length of the urethane strip, either as originally assembled to the wafers 40 or as cut to the desired length. A second form shown in FIG. 10 includes a series of male wafers 40 which again are the same as those shown in FIG. 3. In this form the base walls 48 of each of a series of wafers 40 are provided with downwardly opening slots 49 which receive the strip 47 of urethane rubber. In the third form of the third embodiment as shown in FIG. 11, the side walls 46 of each of a series of wafers 40 are each provided with a shallow groove 51, with the grooves 51 on each side receiving elongated relatively thin strips 53 of urethane rubber. It will be noted that the strips 53 project outwardly beyond the extent of each of the grooves 51 for a purpose to be described. In each form of the third embodiment, the strips of urethane rubber may be preformed and then assembled to the wafers 40 or may be formed in situ or in place through molding or otherwise. It will be appreciated that the female wafers 42 may be assembled in the same manner as the male wafers 40 to provide complementary modules to the male modules shown in FIG. 11.

Referring now to FIGS. 12 and 13, one form of a fourth embodiment of the invention comprises a pleated or accordion folded length or strap 68 of metal. The male and female modules 70 and 72 include: body portions having side edges 74 which correspond to the side walls 46 and 58 of the first, second and third embodiments, and, lower juncture ribs 76 which correspond to the base walls 48 and 60 of such embodiments. The upper junctures or ribs of the male module 70 are cut away except for the narrow portion 78 at the apex of the bead portion 80, which corresponds to bead portion 52 and merges into the upper wall 82 of the strap across concave shaped shoulders 84 which correspond to shoulders 54.

The upper junctures of the female module 72 are cut away except for the narrow portions 86 which provide the upper wall. The groove portion 88 corresponds to groove portion 64 and projects inwardly of the body portion. The convex shaped shoulders 90 join the groove portion to portions 86 and correspond to shoulders 66. The bead and groove portions 80 and 88 and the shoulders 84 and 90 are of matching shape.

The straps 68 may be formed in the flat in a progressive die and then folded or pleated. The folds or pleats are shown open but would be compressed when the modules are mounted in slots in die binders, as will be explained.

FIG. 14 shows another form of the fourth embodiment which is generally the same as the one form except that the bead portion 92 and concave shoulders 94 of the male module 96 are formed in the upper unconnected wall 98 of a strap 100 which provides the module. The module also includes a lower unconnected base wall 102 and side walls 104 connected by ribs 106. The female module is not shown but would be of the same general structure except for a groove portion and convex shoulders. Both forms may be made in a progressive die.

Referring now to FIG. 15, upper and lower die binders 110 and 112 are provided with generally U-shaped cross-section elongated slots 114 and 116 having base walls 118 and side walls 120. The slots match the shape of the body portions of all embodiments. The slot 114 is larger than the body portions of the male modules while only the side walls 120 of the slot 116 are wider than the side walls of the female modules. In order to mount the male and female modules 40 and 42 of the first embodiment in their respective slots 114 and 116, shims 122 of semi-resilient material, such as urethane, are fitted between the side walls 46 and 58 of the modules and the matching side walls 120 of the slots. These shims are slightly compressed when the modules are inserted into the slots so as to releasably retain the modules therein. The female module 42 has its base wall 60 seated on the base wall 118 of groove 116. The side wall shims 122 are not necessary with the third form of the second embodiment shown in FIG. 11.

The extent of projection of the bead portion 52 is controlled by a base wall shim 124 of the same material as the shims 122 which fits between the base wall 118 of the slot and the base wall 48 of the module. The thickness of the shim 124 sets the extent of projection of the bead portion 52 from the slot 114 and adjustment is easily and quickly obtained by changing the shim 124 to one of different thickness. Additionally, the shim 124 also absorbs shock loads when the modules close against a blank as will be described.

Although the base wall 60 of the module 42 seats on the base wall 118 of the slot a base wall shim similar to shim 124 could be provided between such base walls if desired.

The adjustment range of the male module 40 is indicated in FIG. 15 and any position of the bead portion 52 within this range can be obtained by adjusting the thickness of the shim 124 from the maximum size shown to entirely dispensing therewith.

It will be noted from FIG. 15 that the edge portion of the blank 16 must move over and around the interfitting concave and convex shoulders 54 and 66 and the interfitting bead portion 52 and groove portion 64 as the blank is moved within the die cavity by the punch. Since the radii of the shoulders 54 and 66 and that of the bead and groove portions 52 and 64 differ by the thickness of the sheet metal blank 16, the blank must conform to such radiused shoulders and portions. The deformation component of the restraining force which can be obtained will be equal to the deformation component which can be obtained from a conventional drawbead structure but with much less penetration of the bead portion 52 within the blank 16. FIG. 16 charts drawbead restraining force vs penetration for the modular structure of this invention and a conventional structure.

It should also be noted that the arc length of the bead portion of the male module determines the penetration necessary for full bending of the blank 16. FIG. 15 shows a one-half arc length bead portion 52 i.e. the arc length of bead portion 52 and groove portion 64 is 90° and those of shoulders 54 and 66 is 45°. In a two-third arc length arrangement, the arc length of bead portion 52 and groove portion 64 is 120° and those of shoulders 54 and 66 is 60°.

Referring now to FIG. 17, a portion of a lower die binder 112 is shown with a longitudinally arcuate slot 128 formed therein and of the same cross-section as slots 114 and 116. The first embodiment, third embodiment, and second form of the fourth embodiment shown in FIG. 14 may be used in such an arcuate slot. The radius of the slot will limit the thickness of the wafers of the first and third embodiments which can be used therein and also determine whether the second form of the fourth embodiment may be used therein. The shims 122 and 124 are used.

Both forms of the fourth embodiment of the invention shown in FIGS. 12, 13 and 14 will be mounted in their respective slots in die binders in the same manner in which the first, second and third embodiments are mounted in their respective slots. Such forms of the fourth embodiment may be completely folded or partially open, as desired.

Thus this invention provides an improved modular drawbead structure.

The embodiments of the invention in which an exclusive property or privilege is claimed are defined as follows:

1. A drawbead structure for a pair of die binders which close relative to each other and to a blank during press operation comprising, in combination, each die binder having an elongated outwardly opening slot therein, the slots being generally aligned when the binders close relative to each other, a male drawbead module located in one slot and a female drawbead module located in the other slot, the male module including a body portion having a base wall, an outer wall and side walls, and a bead portion projecting from the outer wall of the body portion and merging into such outer wall across concave shaped shoulders, the base and side walls of the body portion matching respective walls of the one slot but spaced therefrom, the female module including a body portion having a base wall, an outer wall and side walls, and a groove portion projecting within the body portion from the outer wall and merging into such outer wall across convex shaped shoulders, the groove portion interfitting with the bead portion and the convex shoulders opposing the concave shoulders, the base and side walls of the body portion of the female module matching respective walls of the other slot, first resilient means located between the base wall of at least one of the female and male modules and the base wall of a respective slot to set the spacing between the interfitting groove and bead portions and opposing shoulders of the modules and thereby set the drawbead restraining force and absorb shock loads when the modules are engaged against a blank, and second resilient means between the side walls of the modules and like walls of a respective slot to permit limited self-centering movement of the modules laterally of a respective slot upon closure of the module against a blank.

2. A drawbead structure for a pair of die binders which close relative to each other and to a blank during press operation comprising, in combination, each die binder having an outwardly opening slot of elongated arcuate shape, the slots being generally aligned when the binders close relative to each other, a male drawbead module located in one slot and a female drawbead module located in the other slot, the male drawbead module including a series of wafers, each having a body portion having a base wall, an outer wall, side walls, and a bead portion projecting from the outer wall of the body portion and merging into such outer wall across concave shaped shoulders, the walls of the body portion of the wafers being spaced from respective walls of the one slot, the body portion of the wafers partially abutting each other to allow the wafers to follow the arcuate shape of the slot, the female drawbead module including a series of wafers, each having a body portion having a base wall, an outer wall, side walls, and a groove portion projecting within the body portion from the outer wall and merging into such outer wall across convex shaped shoulders, the groove portion interfitting with the bead portion and the convex shoulders opposing the concave shoulders, the side walls of the body portion of the wafers being spaced from respective walls of the other slot, the body portions of the wafers partially abutting each other to allow the wafers to follow the arcuate shape of the slot, first resilient means located between the base walls of at least one of the female and male modules and the base wall of a respective slot to set the spacing between the interfitting groove and bead portions and opposing shoulders of the respective modules and thereby set the drawbead restraining force and absorb shock loads when the binders are closed against a blank, and second resilient means between the side walls of each module and like walls of a respective slot to permit the wafers of each module to follow the arcuate shape of a respective slot.

3. A drawbead structure for a pair of die binders which close relative to each other and to a blank during press operation comprising, in combination, each die binder having an elongated outwardly opening slot, the slot being generally aligned when the binders close relative to each other, a male drawbead module located in one slot and a female drawbead module located in the other slot, the male drawbead module including a pleated length of material defined by a series of adjacent successive body portions joined to each other by upper and lower junctures, the lower junctures providing the base wall of the module, the free side edges of the body portions providing the side walls of the module, and the upper junctures being cut away to provide bead portions apically joined to each other and merging into the body portion across concave shaped shoulders, the base and side walls of the body portion matching respective walls of the one slot and spaced therefrom, the female module including a pleated length of material defined by a series of adjacent successive body portions joined to each other by upper and lower junctures, the lower junctures defining the base wall of the module, the upper junctures being cut away to provide a groove portion projecting within the body portion and merging across convex shoulders into juncture portions defining the outer wall of the module and located adjacent the free side edges of adjacent body portions, the bead and groove portions interfitting with each other and the concave and convex shoulders opposing each other, first resilient means located between the base wall of at least one of the female and male modules and the base wall of a respective slot to set the spacing between the matching groove and bead portions and matching shoulders of the respective drawbead modules and thereby set the drawbead restraining force and absorb shock loads when the binders close, and second resilient means between the side walls of at least one of the modules and like walls of a respective slot to permit limited movement of the one module laterally of a respective slot to thereby obtain self-centering of the one module relative to the other module upon closure of the binders.

4. A drawbead structure for a pair of die binders which close relative to each other and to a blank during press operating comprising, in combination, each die binder having an outwardly opening slot, the slots being generally aligned when the binders close relative to each other, a male drawbead module located in one slot and a female drawbead module located in the other slot, the male drawbead module including a series of wafers, each having a body portion of the general shape of one of the die binder slots and having an outer wall, a bead portion projecting from the outer wall of the body portion, and merging into such outer wall across generally concave shaped shoulders, the female drawbead module including a series of wafers, each having a body portion of the general shape of the other die binder slot and having an outer wall, a groove portion projecting within the body portion from the outer wall and merging into such outer wall across generally convex shaped shoulders, the groove portion interfitting with the bead portion and the generally convex shoulders opposing the concave shoulders, means interconnecting the wafers of each module, and means mounting each module within a respective die binder slot.

5. The combination recited in claim 4 wherein the means interconnecting the series of wafers of at least one module is provided by forming such series of wafers integral with each other.

6. The combination recited in claim 4 wherein the means interconnecting the series of wafers of at least one module includes an elongated strip of resilient material extending through the series of wafers and permitting limited movement of the wafers relative to each other to allow the series of wafers to follow the shape of the die binder slot receiving the series of wafers.

7. The combination recited in claim 4 wherein the means interconnecting the series of wafers of at least one module includes an elongated strip of resilient material extending through aligned closed slots through the series of wafers,

8. The combination recited in claim 4 wherein the means interconnecting the series of wafers of at least one module includes an elongated strip of resilient material extending through aligned outwardly opening slots in the series of wafers.

9. The combination recited in claim 4 wherein the means interconnecting the series of wafers of at least one module includes an elongated strip of resilient material extending through aligned outwardly opening slots in the series of wafers and resiliently engaging the die binder slot receiving the one module.

10. The combination recited in claim 4 wherein at least one of the modules comprises a pleated length of the series of wafers with adjacent edges of the body portions of the wafers being integrally interconnected.

11. The combination recited in claim 4 wherein at least one of the modules comprises a pleated length of the series of wafers, with the body portions having side edge portions which are integrally connected.

* * * * *